United States Patent [19]

Cetrelli

[11] Patent Number: 4,559,259

[45] Date of Patent: Dec. 17, 1985

[54] PACKING LAMINATE PROVIDED WITH CREASE LINES

[75] Inventor: Renato Cetrelli, Lund, Sweden

[73] Assignee: Tetra Pak International AB, Lund, Sweden

[21] Appl. No.: 194,342

[22] Filed: Oct. 6, 1980

[30] Foreign Application Priority Data

Oct. 18, 1979 [SE] Sweden ..... 7908645

[51] Int. Cl.[4] ..... B26D 3/08; B32B 3/30; B65D 5/42

[52] U.S. Cl. ..... 428/167; 428/35; 428/130; 428/201; 428/211; 493/59; 493/60; 493/61; 493/160; 493/161; 493/396; 493/404

[58] Field of Search ..... 428/167, 201, 211; 493/396, 404, 59, 60, 61, 160, 161; 229/DIG. 4; 206/484

[56] References Cited

U.S. PATENT DOCUMENTS

| | | | |
|---|---|---|---|
| 1,650,051 | 11/1927 | Smith | 428/60 |
| 1,758,230 | 5/1930 | Lange | 229/DIG. 4 |
| 2,558,918 | 7/1951 | Zinn, Jr. | 229/DIG. 4 |
| 2,634,046 | 4/1953 | Weber | 229/DIG. 4 |
| 3,240,845 | 3/1966 | Voelker | 428/167 |
| 3,526,566 | 4/1970 | McIlvain | 428/167 |
| 4,129,065 | 12/1978 | Corse | 493/396 |
| 4,265,390 | 5/1981 | Faller et al. | 229/DIG. 4 |
| 4,287,247 | 9/1981 | Reil et al. | 428/129 |

FOREIGN PATENT DOCUMENTS

| | | | |
|---|---|---|---|
| 888215 | 1/1962 | United Kingdom | 493/396 |
| 2031345A | 4/1980 | United Kingdom | 206/484 |

*Primary Examiner*—James C. Cannon

*Attorney, Agent, or Firm*—Burns, Doane, Swecker & Mathis

[57] ABSTRACT

A packing laminate which is intended to be converted into packing containers is often provided with crease lines in order to facilitate folding and shaping. At the places where crease lines cross each other a multiple folding of the laminate takes place on conversion into packing containers which, among other things, means that small cracks are formed in the different material layers, so that the tightness of the packing container is put into jeopardy. In accordance with the invention, a packing laminate is proposed in which these difficulties are overcome by providing the laminate with specially designed auxiliary crease lines which in the region of the laminate, where the folding lines cross each other or meet, replace the (main) crease line guiding the folding line. The auxiliary crease lines are situated at such a distance from the main crease line that the folding line is not affected, that is to say, the folding line will after folding not coincide in any part with the auxiliary crease lines. The auxiliary crease lines will merely be situated on either side of the folding line in such a manner that the auxiliary crease lines take up and guide the crease formation or "wrinkling" which normally arises in the inner laminate layer in the folding line itself.

3 Claims, 3 Drawing Figures

PACKING LAMINATE PROVIDED WITH CREASE LINES

BACKGROUND AND SUMMARY OF THE PRESENT INVENTION

The present invention relates to a packing laminate provided with crease lines for conversion into packing containers.

Packing containers of the non-returnable type are frequently manufactured from a web or sheetlike material provided with crease lines and converted by folding and sealing into a packing container of the desired shape. Use is made, among other things, of a laminated material which comprises different material layers to give the combined laminate the desired properties, particularly when it is a question of rigidity, strength and impermeability to liquids. A packing laminate frequently used comprises a centrally located, relatively thick carrier layer of fibrous material, which layer is covered on both sides with homogenous plastic layers. The plastic layers are made of thermoplastic material, which makes possible a simple sealing of the laminate by heating and pressing together of the plastic layers on the two parts of laminate which are to be joined together.

To reduce the light transmission of the packing laminate, the laminate also frequently comprises further layers, e.g. a layer of aluminium foil, located between the carrier layer and one of the thermoplastic layers, which in the finished packing container very effectively protects the packed contents from the effects of the light.

In the formation of the packing containers the packing laminate is subjected to great stresses. This is the case in particular during the folding of the laminate, since a folding of the laminate, owing to the relatively great rigidity of the carrier layer, means that the thermoplastic layer which in relation to the direction of folding is on the "outside", is subjected to a strong stretching. At the same time the thermoplastic layer which, in relation to direction of folding is on the "inside", is pressed together and "wrinkled" along the whole folding line. However, owing to the great extensibility of the thermoplastic material, this only rarely leads to the thermoplastics being damaged and losing its impermeability to liquids. However, the situation is aggravated, if the packing laminate also comprises layers of aluminium foil, since these aluminium layers, compared to the thermoplastics layers, have extremely low extensibility and thus tend to crack at relatively small stresses.

In a laminate of the type described above, with or without aluminium foil, a single folding over 180° along a folding line normally does not involve serious consequences either with regards to the imperviousness to liquids of the laminate or its transmission of light. However, greater difficulties may arise when two such folding lines cross one another, which is often the case along the seal or seals which are always present on packing containers. These seals usually are made by heating the thermoplastic layers which are facing towards the inside of the packing container along the edge zones of the packing laminate which are to be joined to one another. The two layer areas heated to softening temperature are brought together and are compressed so that a sealing joint is produced which is situated on the outside of the packing container and comprises two laminate layers. So as not to form an obstacle, the sealing fin is often folded down against the outside of the packing container, which means that the one laminate layer is subjected to 180° folding and that the folding container wall in the actual sealing area consists of three laminate layers, that is to say it has threefold thickness.

A seal of the type described above often runs along one or more side surfaces of the packing container, and since these side surface, e.g. on formation of parallelepipedic packages, are subjected to further folding over 180° along folding lines which run at an angle of 90° to the seal (described in more detail in the following), the material thickness in certain limited areas of the packing container will go up to 6 times the laminate thickness. During this folding over 180° transversely to the sealing area, the laminate layers, which after the folding are situated on the outside of the folding (that is to say the material layers situated outside the eventual neutral plane), will be subjected to very great tensile stresses with accompanying elongations and crack formations. These tensile stresses are so great that frequently not only any layers of aluminium foil included in the laminate, but also the thermoplastic layer, cracks with the consequence that leakage takes place.

To overcome the abovementioned disadvantages it has been tried before, among other things, to increase the elasticity of the materials included as much as possible. This arrangement produced relatively good results with regard to the thermoplastic layers, but did not solve the problem insofar as any aluminium layers included in the laminate are concerned.

Another known solution suggests that parts of the carrier layer of the laminate should be punched out, just at the critical folding points. It is possible in this manner for the remaining plastic and aluminium layers to come nearer to the neutral plane of the folding and more or less accurately follow the same around the folding, so that the elongation stresses are reduced. This solution produces a certain positive effect, but complicates at the same time the manufacture of the material, since the waste material which arises at the punching out of parts of the carrier layer has to be taken care of.

It is also known that in thick laminated material, e.g. corrugated cardboard, each folding line can be formed by means of a number of crease lines situated close to each other. In this manner a folding over 180° is divided into several smaller foldings situated closely next to each other. This arrangement of course facilitates the folding process itself, but as a final result produces a folded sheet of relatively great thickness which does not allow a further folding.

It is an object of the present invention to provide a packing laminate provided with crease lines which makes it possible to carry out the abovedescribed foldings without any risk of crack formation and leakage and without the disadvantages which affected methods proposed previously.

It is a further object of the present invention to provide a packing laminate which can be folded in such a manner that a sharp and well-defined folding is obtained, which folding does not render the material too thick for further folding along a folding line crossing the firstnamed folding.

These and other objects have been achieved in accordance with the invention in that a packing laminate provided with crease lines for conversion into packing containers has been given the characteristic that a crease line, which during the shaping of the package forms a folding line in the laminate, includes an interruption where the crease line is replaced by two auxiliary crease lines running in the main direction of the crease line, which are situated on either side of the remaining folding line and at such a distance from the same that the folding line after folding extends between the said auxiliary crease lines without coinciding with them at any part.

In the area of the laminate situated between the auxiliary crease lines the folding will be carried out without any crease line, so that in this area the folding will be considerably sharper and more well-defined than in the parts of the laminate where the folding takes place with the help of crease lines. This is due to the fact that the crease formation or "wrinkling", which unadvoidably occurs on folding in the inner layers, will be concentrated to an adjacent crease line (if one is present), since the adjacent crease line acts as an indication line for crease formation. The crease formation in the embodiment according to the invention is shifted from the folding line to the auxiliary crease lines extending at a distance from the folding line. As a result the folding line will be sharp and well-defined and the total material thickness at the place of folding is reduced to approximately double the true material thickness. This double thickness is an appreciable reduction compared with previously when folding guided by crease lines often had a thickness which amounted to between three and four times the true material thickness. A folding formed in accordance with the invention is therefore no obstacle to the further folding of the material along folding lines which cross or meet the firstmentioned folding.

BRIEF DESCRIPTION OF THE DRAWINGS

A preferred embodiment of the packing laminate provided with crease lines in accordance with the invention will now be described in detail with special reference to the enclosed schematic drawings which include only the details required for an understanding of the invention and wherein.

DETAILED DESCRIPTION OF THE PREFERRED EMBODIMENT

The packing laminate of the type described in the introduction, that is to say packing laminate which is intended to be converted to packing containers, usually comprises a central carrier layer of paper which is covered on both sides with layers of thermoplastic material. The packing laminate frequently is provided with a layer of aluminium. The thickness of the packing laminate is determined mainly by the carrier layer and usually amounts to approximately 0.35 mm. On folding of such a packing laminate along a straight folding line, the neutral plane of the laminate (that is to say the plane in the laminate where either tensile or compressive stresses arise on folding) will be situated in the carrier layer of the laminate. This means unadvoidably that the layer or layers situated outside the carrier layer will be subjected to tensile stresses at the same time as the layers situated inside the carrier layer, that is to say the layers facing towards the inside of the folding, are subjected to compressive stresses. The stresses cause a compression and subsequent crease formation or "wrinkling" of the surface layer of the laminate facing towards the inside of the folding. The crease formation results in a number of substantially parallel creases which extend along the folding line so that a sharp and well-defined folding of the laminate is prevented.

Figure 2:
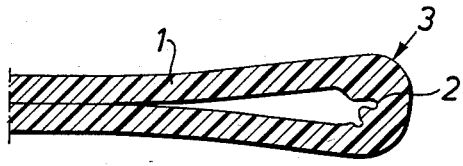
FIG. 2 is a cross-sectional view of a portion of a double-folded laminate which is provided with a conventional crease line guiding the folding.

To ensure that the folding of the laminate should occur at the desired place and in the desired directions, the packing laminate is often provided with crease lines, that is to say linear impressions in the material which are intended to guide the folding. It has been found that this increases the abovementioned problem, since the crease line not only guides the folding, but also serves as an indication for the crease formation. The crease formation will thus be stronger and more pronounced along the crease line, so that the folded laminate is given a thickening or bulge. This thickening or bulge is illustrated in FIG. 2 of the drawing, where a cross-sectional view through a part of a packing laminate folded along a conventional crease line is illustrated. The packing laminate in FIG. 2, as mentioned earlier, consists of several layers (not illustrated for the sake of clarity). The packing laminate, indicated by reference numeral 1, has formed along the crease line 2, situated inside the folding, a number of longitudinal creases in the inner lamination layer. These creases render difficult a sharp folding of the laminate and produce a bulge formation 3 which is clearly visible on the outside of the folding. A further folding of a laminate double-folded in this manner along a folding line which crosses or meets the crease line 2 would infallibly give rise to such elongations in the outer layer of the material 1 that the same would break.

The difficulties of repeated foldings along crease lines crossing or meeting one another can apparently be overcome if the foldings, or in any case the folding carried out first, could be made sharper so that the material thickness in the double-folded area is reduced. It has been found that this is achieved in accordance with the invention in that the crease line which in the shaping of the package forms the folding line in the laminate is interrupted at a given place and is replaced by two auxiliary crease lines. The auxiliary crease lines are situated on either side of the firstmentioned crease line and extend substantially parallel with the same. By the appropriate choice of the length of the interruption in the firstmentioned crease line (hereinafter called main line), the formation of a rectilinear folding line will not be affected. With the help of the auxiliary crease lines situated on either side of the folding lines the crease formation or "wrinkling" of the laminate layer facing towards the inside of the folding can be reduced in this manner and shifted from the folding line to the adjoining auxiliary crease lines. See FIG. 3 which represents a section, corresponding to FIG. 2, through a part of a double-folded laminate in accordance with the invention. The laminate is indicated by reference numeral 4 whilst the folding line is indicated by reference numeral 5, and the two auxiliary crease lines situated on either side of the folding line by reference numeral 6. It is clearly evident how the folding along the folding line 5 has been made sharper owing to the crease formation being shifted to the two auxiliary crease lines 6 situated at some distance from the folding line. At the same time the bulge formation 3, inevitable in the earlier folding procedure (FIG. 2), has disappeared. Accordingly, the double-folded laminate 4, without inconvenience, can be double-folded again along the folding lines crossing or meeting the folding line 5.

Figure 1:
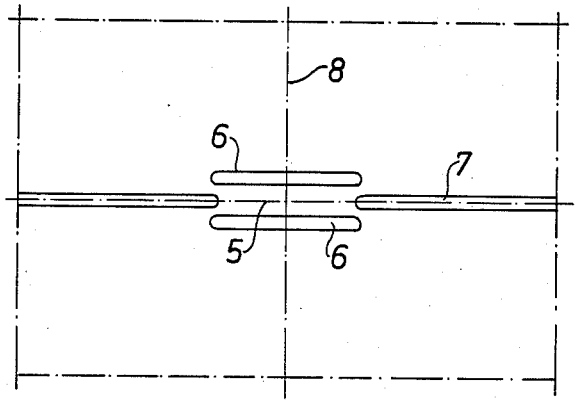
FIG. 1 is a schematic view of a portion of a crease line pattern on a packing laminate in accordance with the invention.
Figure 3:
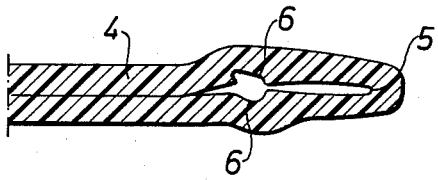
FIG. 3 is a cross-sectional view of a portion of a double-folded packing laminate in accordance with the invention.

In order to make clearly visible the packing laminate provided with crease lines in accordance with the invention and especially the crease line pattern which makes possible the folding in accordance with FIG. 3, the crease line pattern is illustrated schematically in FIG. 1. A crease line 7, which in the package shaping forms the folding line 5 (dash-dotted in FIG. 1) in the laminate, comprises an interruption, in which the crease line 7 is replaced by the two auxiliary crease lines 6 extending in the main direction of the crease line. The auxiliary crease lines 6 are situated on either side of the remaining folding line 5 and at such a distance from the same that the folding line 5 after folding runs between the auxiliary lines without coinciding at any part with the auxiliary lines. It is assumed here, as in other parts of the description and the patent claims, that the folding line 5 coincides with a straight imaginary line joining the end points of the main crease line facing one another.

Practical experiments have shown that the folding line runs with satisfactory rectilinearity between the two end points of the main crease line 7, even if there is a relatively great distance between these. However, the result will depend on the quality of the laminate and on its thickness. In order to ensure a good result it has been found appropriate for the crease line 7 to have a length which corresponds to 20 to 80 times the thickness of the laminate. The lower limit is determined by the minimum distance which is practically applicable without the laminate becoming so softened up that the guiding of the folding lines is jeopardized at lines crossing each other.

The two auxiliary crease lines 6 are mutually parallel and are situated symmetrically in relation to the folding line 5. If the folding line 5 is to extend rectilinearly between end points of the main crease line 7, it is assumed of course also that the distance between each auxiliary crease line 6 and the prolongation of the main crease line 7 is such that the folding line 5 is not affected and guided by the auxiliary crease lines 6 so that it tends to follow either of the two. As mentioned earlier, the two auxiliary crease lines results in the crease formation in the inner layer of the material being concentrated onto these auxiliary lines. It is also assumed therefore for a good function that the auxiliary crease lines should be located at a certain distance from the folding line 5. It has been found that suitable values for the distance between each auxiliary crease line 6 and the folding line 5 amount to between 3 and 15 times the thickness of the laminate. In this context the description folding line refers to a straight line which connects the two end points of the main crease line 7. The distance between each auxiliary line and the folding line 5 is affected by the thickness of the laminate inasmuch as the crease formation will be stronger the thicker the laminate. Accordingly, the distance between the folding line and the auxiliary crease lines must thus be increased to a corresponding degree, so that the crease formation should not affect the folding line. In the laminate referred to earlier of a thickness of 0.35 mm, it has been found appropriate for the distance between each auxiliary crease line 6 and the folding line to amount to approximately 2.5 mm.

As can be seen in FIG. 1, the auxiliary crease lines 6 are preferably as long as the interruption in the crease line 7. It is also conceivable to design the auxiliary lines 6 a little shorter than the interruption, whilst on the other hand auxiliary crease lines which are longer than the interruption should be avoided. The reason for this is that the end points of the auxiliary crease lines in such a case will be too near to the end points of the main crease line. This may result in the laminate in these areas being softened up so that the folding line is not given a satisfactory guidance in the space between the auxiliary crease lines.

The auxiliary crease lines are placed appropriately in the region of the packing laminate where it is subjected to special stresses, e.g. in the area where folding lines meet or cross each other. A crossing folding line is illustrated schematically on FIG. 1 by a dash-dotted line 8, but may be constituted in reality by a continuous crease line.

The shifting of the crease formation which takes place on folding of a packing laminate provided with crease lines in accordance with the invention is associated with the fact that the area of the packing laminate situated between the auxiliary crease lines 6 is wholly or partly delaminated. The delamination is brought about when the crease lines 6 are impressed and means that on folding of the laminate the outer layer facing towards the inside of the folding can be shifted in relation to the carrier layer of the laminate. In this way the material surplus which arises does not result in crease formation in the folding line, but is shifted to the auxiliary crease lines 6, which facilitate and guide the crease formation. The laminate 4 will obtain therefore at the level of the auxiliary crease lines 6 a slight thickening which, however, will not form an obstacle to the further folding of the laminate, since it is located at a distance from the folding line 5.

The packing laminate provided with crease lines in accordance with the invention makes possible multiple folding along folding lines crossing one another without the foldings becoming so thick that crack formation occurs in the outer layers. This is achieved in a manner at little extra cost by an appropriately designed crease line pattern which is possible to produce even at the manufacture of packing laminate at very high speeds.

The principles, preferred embodiment and mode of operation of the present invention have been described in the foregoing specification. However, the invention which is intended to be protected is not to be construed as limited to the particular embodiment disclosed. The embodiment is to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

I claim:

1. A packing laminate for conversion into packing containers, said laminate comprising a crease line which during the shaping of the packing container forms a first folding line in the laminate, said crease line having an interruption where the crease line is replaced by two auxiliary crease lines running in the main direction of the crease line, the interruption in the crease line being of a length which is 20 to 80 times the thickness of the laminate, one of said auxiliary crease lines being arranged on each side of the first folding line, said auxiliary crease lines being mutually parallel and located symmetrically in relation to the folding line, the distance between each auxiliary crease line and the folding line is between 3 and 15 times the thickness of the laminate, the folding line after folding extends between said auxiliary crease lines without coinciding with any portion of the auxiliary crease lines, and the area of the packing laminate between the auxiliary crease lines being at least partially delaminated.

2. The packing laminate in accordance with claim 1, wherein each of the auxiliary crease lines is equal in length to the interruption in the crease line.

3. The packing laminate in accordance with claim 1, wherein the auxiliary crease lines are arranged in a region of the packing laminate where a second folding line meets or crosses the first folding line.

* * * * *